US005513550A

United States Patent [19]

Field

[11] Patent Number: 5,513,550

[45] Date of Patent: May 7, 1996

[54] FIREARM WITH PIVOTING BARREL

[76] Inventor: Roger C. Field, Postfach 950169, 81517 Munich, Germany

[21] Appl. No.: 235,701

[22] Filed: Apr. 29, 1994

[30] Foreign Application Priority Data

May 4, 1993 [DE] Germany ..... 9306692 U

[51] Int. Cl.[6] ..... F41A 5/04

[52] U.S. Cl. ..... 89/163; 89/33.05; 89/26; 42/84

[58] Field of Search ..... 89/163, 33.05, 89/26; 42/12

[56] References Cited

U.S. PATENT DOCUMENTS

| | | | |
|---|---|---|---|
| 2,865,255 | 12/1958 | Marsh | 89/163 |
| 3,613,282 | 10/1971 | Ramsay | 42/84 |
| 3,628,272 | 12/1971 | Van Langenhoven | 42/39.5 |
| 3,728,937 | 4/1973 | Nelson et al. | 89/7 |
| 5,105,569 | 4/1992 | Straitiff | 42/2 |
| 5,317,951 | 6/1994 | Reynolds | 89/160 |

*Primary Examiner*—Charles T. Jordan
*Assistant Examiner*—Christopher K. Montgomery

[57] ABSTRACT

A firearm for firing cartridges (2) which may in at least one embodiment fire caseless cartridges (2), having a barrel (1) pivoting around a pivot point (11) from a firing position to a loading position, and back to the firing position. A fixed wall (16) is positioned behind chamber (19) when barrel (1) is in the firing position, which absorbs the recoil of a fired cartridge (2). A plug (6) may be used to seal chamber (19) when firing caseless cartridges (2). The pivoting movement of barrel (1) may be activated against spring (4) by gas pressure from a fired cartridge (2) escaping from a hole (3) in barrel (1). Residual gas in barrel (1) may be used to move rammer (7) against spring (8) and rammer (7) then chambers a cartridge (2). Barrel (1) then returns to the firing position.

13 Claims, 1 Drawing Sheet

FIREARM WITH PIVOTING BARREL

Figure 1:
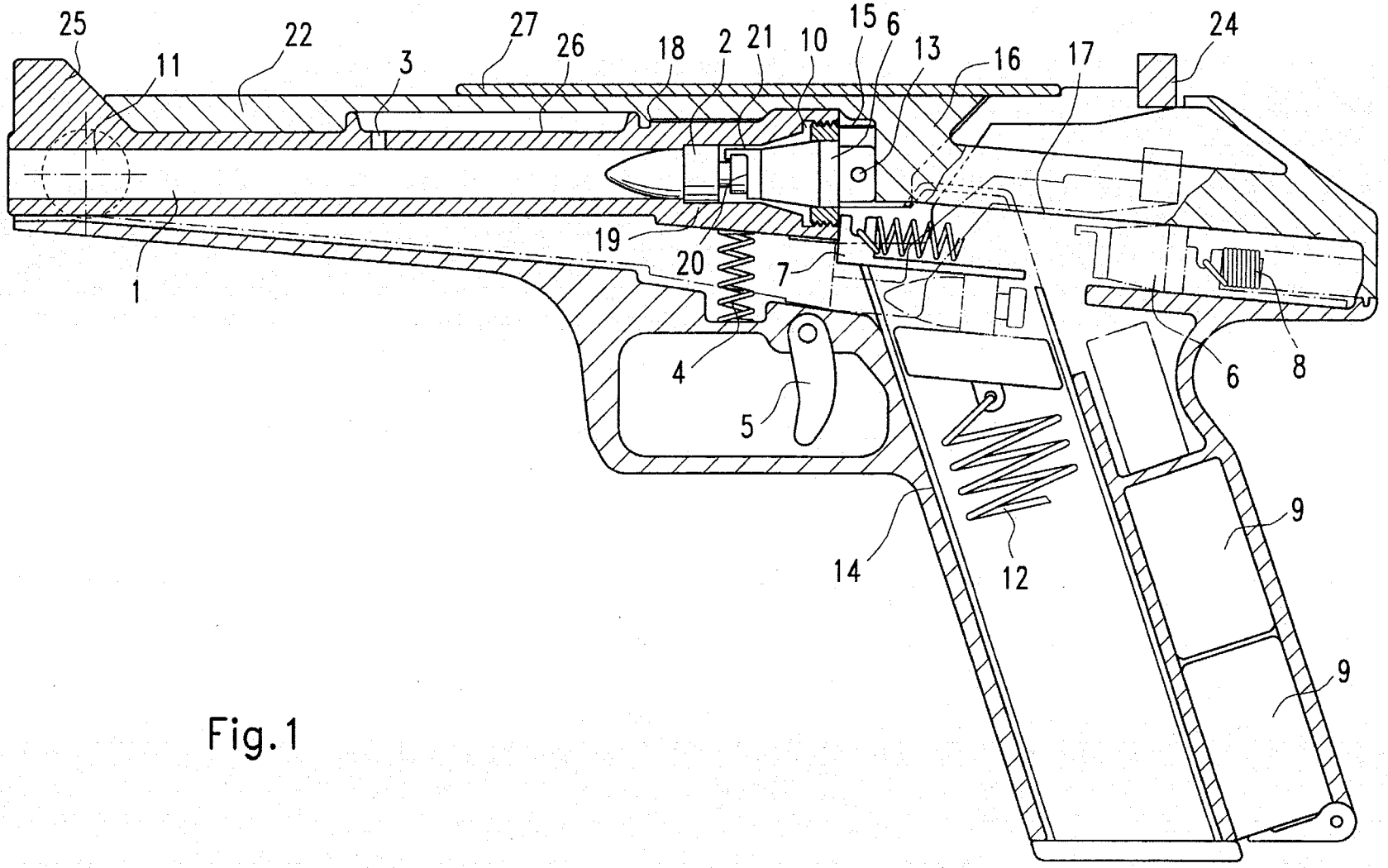

The invention is a semi or fully automatic firearm for cased or caseless cartridges. The system is suitable for many firearms of this type, preferably however for a semi automatic pistol.

Firearms of this type, especially pistols, have a ramp, which is mechanically stressful to the cartridge and bullet since the cartridges are forcibly driven up the ramp from stored cartridges such as a magazine, into the chamber. This is not desirable for caseless cartridges which are not as strong as metal cartridges. It is not uncommon for such firearms to jam, or for their slides or belts not to go into battery. Furthermore, the type of bullet used is limited to that which will feed properly. Wadcutters for instance, are not used in normal pistols. Cartridges larger than 0.380 caliber usually need a locking method to delay slide or bolt travel until the pressure in the bore has dropped to a safe level after a cartridge has been fired. It has been found in pistols of conventional design that the first shot groups differently from the next shots. Accuracy in conventional pistols is usually impaired by a summation of tolerance between the barrel and slide and the slide and frame. The sights on conventional pistols are attached to the slide, which is not attached to the barrel. The barrel itself is frequently non-rigid, requiring its movement to unlock from the slide. Revolvers do not exhibit these shortcomings, but have disadvantages of their own, most notably their number of stored cartridges. Used cartridges leave a residue in the bore after a few shots have been fired, which impairs the accuracy of the firearm. Caseless cartridges leave the bore much cleaner, thus contributing to the firearm's continued accuracy during prolonged shooting. Conventional pistols must be frequently oiled to ensure that the slide travels along the frame without undue resistance and wear.

It is the purpose of the invention to provide a firearm, notably a semi-automatic pistol without the shortcomings of conventional pistols and revolvers. This firearm negates the use of a ramp by having straighter or straight feeding into the chamber by either having a minimal ramp or no ramp at all. This pistol need have no locking and the sights may, if desired, both be attached to the barrel. The pistol may use caseless cartridges, when provided with means for sealing the chamber. The firearm may be manufactured for using either caseless cartridges, cased cartridges or be converted for both.

The firearm has a barrel which may pivot in any direction, but preferably downwards, the pivot point being located preferably at the front of the barrel. At least one fixed wall is located behind the chamber in its upper, firing, position, which fulfills the same purpose as the fixed recoil shield of a revolver, to counter the recoil of the cartridge. When the cartridge is fired, the barrel pivots downward, so that the chamber moves downward. The chamber is exposed underneath the fixed wall, allowing a cartridge case to be extracted or a new cartridge to be inserted without a ramp, by a rammer, for example. The barrel may, for example, be pivoted by gas pressure from gas bled from the barrel after the cartridge has been fired.

One or more holes may be located in the barrel. Gas taken off the barrel may be used directly to force the barrel downward, or a chamber may be located around the hole to gather gas pressure. A piston arrangement may also be used. A rammer located behind the chamber in its bottom loading position pushes a cartridge from stored cartridges, for example, a magazine. This rammer may have an extractor hook for cased cartridges.

A slide may be used which reciprocates in the conventional manner after the barrel pivots, acting as a rammer. A slide used only for cocking the firearm need not reciprocate after cocking, in another embodiment of the invention. The recoil wall is attached to a housing. "Housing" may include a frame, depending on the construction of the firearm.

A plug may be used for caseless cartridges, extending into the chamber. The chamber may have a sealing ring or several rings. The sealing ring encircles the plug when the plug is in the chamber. The front of the plug may be hollow and encase the rear of a caseless cartridge, sealing the (obturating) the chamber when a cartridge is fired, as with a cartridge case. The chamber may also have a gas sealing ring mounted inside it. Gas pressure from a fired cartridges exerts pressure on this ring around the plug, which is round in cross-section, and seals the junction between the ring and the plug, thereby sealing the chamber. The plug may have an extractor hook, preferably rigid, for extracting unfired cartridges. This plug attaches to the rammer when the chamber is forced downward. The rammer may be forced back by residual gas in the bore, or it may be forced back by other means such as a piston. A second hole may be used to take gas from the barrel to force the rammer back.

Both front and rear sights may be attached to the barrel. The cartridges may be electrically fired, an arrangement preferred for caseless cartridges. Means such as a chip card or magnetic card, for example, may be employed to enable only the shooter to operate the firearm, which may be disabled when the card is removed. This card may also be used to store information on the shooter.

Gaseless ammunition may be tailored for various bullets for this firearm, for example 9 mm para, 38 SW special and 0.357 magnum. These cartridges may all have the same size propellant, to be fired from the same barrel. Interchangeable barrels and magazines maybe used for different calibers.

A preferred embodiment of the invention is illustrated in FIG. 1. It is obvious that there may be many other embodiments of the invention.

FIG. 1 shows a side section of a self-loading, semi automatic pistol for caseless cartridges.

Barrel 1 has a pivot point 11 of relatively large diameter. Chamber 19 in barrel 1 is pivoted downwards for slightly more than the diameter of cartridge 2. Plug 6 seals chamber 19 behind cartridge 2 in combination with gas sealing ring 10 which presses around plug 6 when gas from a fired cartridge 2 acts upon it. Plug 6 is positioned in front of a fixed wall 16 when in the firing position, which absorbs the recoil against plug 6. An electrical firing element 20 is located in plug 6 which is energized by two battery cells 9. When trigger 5 is depressed, cartridge 2 is electrically fired. The bullet travels forward, chamber 19 is sealed, and plug 6 presses against wall 16. The bullet passes hole 3. Gas pressure is forced through hole 3, filling chamber 26. As the bore pressure is reduced, barrel 1 is forced down around forward pivot point 11, against spring 4. Spring loaded pin 15 engages with housing 22, to keep the rear of barrel 1 down. Plug 6 which has two side pins 13, which has been forced downward with barrel 1, engages with rammer 7. Plug 6 which is now free to travel backwards, is blown back by residual pressure in the bore, forcing rammer 7 against a spring 8. Rammer 7 is pushed forward, pushing the top cartridge out of magazine 14, which has been pushed against roof 26 by spring 12 into chamber 19, and pushes spring loaded pin 15 forward to release barrel 1, the rear of which is pushed upwards by spring 4 which holds barrel 1 up. An unfired cartridge is pulled back into magazine 14 by extractor hook 21 or plug 6 which travels within the top of magazine 14. A misfired cartridge 2 is ejected through the well of magazine 14, after removing magazine 14, or is pulled into magazine 14.

Slide 27 is pulled back to cock the pistol. Barrel 1 is cammed down and rammer 7, which has been engaged by plug 6, is pulled back to allow a cartridge 2 to be positioned in front of plug 6. Slide 27 is released to chamber cartridge 2 and release the rear of barrel 1 of upwards. Slide 7 does not travel backwards during firing of cartridge 2. Barrel 1 is prevented from forcing pressure on pivot 11 when firing a cartridge 2 by engaging with lip 18. Sights 24 and 25 are rigidly attached to barrel 1.

I claim:

1. A self-loading firearm for firing cartridges, having a barrel with a chamber, a recoil wall, a housing, a rammer and means for storing said cartridges, wherein said barrel pivots around a pivot point from a firing position to a loading position, said recoil wall comprising at least one element rigidly attached to said housing, positioned behind and in close proximity of said barrel, to directly absorb the recoil of said cartridges during firing of said cartridges.

2. Firearm according to claim 1 wherein said cartridges are fed into said chamber by said rammer when said barrel is in said loading position.

3. Firearm according to claim 1 wherein said barrel is brought to said loading position by gas pressure.

4. Firearm according to claim 1 wherein said barrel has at least one hole for bleeding gas from a fired cartridge.

5. Firearm according to claim 1 wherein said cartridges are caseless.

6. Firearm according to claim 1 wherein said cartridges are electrically fired.

7. Firearm according to claim 1 wherein front and rear sights are attached to said barrel.

8. Firearm according to claim 1 wherein said cartridges are cased.

9. Firearm according to claim 5 wherein at least one mechanical part is used to seal said chamber when firing said caseless cartridges.

10. Firearm according to claim 9 wherein said at least one mechanical part is a plug.

11. Firearm according to claim 10 wherein said plug is inserted into at least one gas sealing ring mounted inside said chamber.

12. Firearm according to claim 10 wherein said plug has an extractor hook for extracting said cartridges from said chamber.

13. Firearm according to claim 10 wherein said plug for sealing said chamber is hollow in front, enclosing a part of said caseless cartridge to simulate a cartridge case when firing said caseless cartridge by obturating said chamber.

* * * * *